US006549735B2

(12) United States Patent
Fujita et al.

(10) Patent No.: US 6,549,735 B2
(45) **Date of Patent: *Apr. 15, 2003**

(54) DEVELOPING APPARATUS WITH LONGITUDINAL END LEAKAGE PREVENTING MEMBER IN CONTACT WITH SMOOTH SURFACE PART OF A DEVELOPER CARRYING MEMBER

(75) Inventors: Akiyoshi Fujita, Numazu (JP); Kenji Matsuda, Numazu (JP); Tadashi Horikawa, Susono (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,059

(22) Filed: Aug. 30, 1999

(65) Prior Publication Data

US 2001/0012459 A1 Aug. 9, 2001

(30) Foreign Application Priority Data

Aug. 31, 1998 (JP) ..... 10-259202

(51) Int. Cl.[7] ..... G03G 15/08
(52) U.S. Cl. ..... 399/103; 399/274; 399/284

(58) Field of Search ..... 399/103, 105, 399/274, 284

(56) References Cited

U.S. PATENT DOCUMENTS

| | | | | |
|---|---|---|---|---|
| 4,903,634 A | * | 2/1990 | Ono et al. | 399/281 |
| 5,073,797 A | * | 12/1991 | Ono et al. | 399/105 |
| 5,202,729 A | * | 4/1993 | Miyamoto et al. | 399/103 |
| 5,550,619 A | * | 8/1996 | Komakine et al. | 399/149 |
| 5,701,558 A | * | 12/1997 | Kojima | 399/103 |

FOREIGN PATENT DOCUMENTS

| | | | |
|---|---|---|---|
| DE | 0 314 436 | * | 5/1989 |
| JP | 54-43038 | | 4/1979 |
| JP | 61-28977 | * | 2/1986 |
| JP | 7-72734 | * | 3/1995 |
| JP | 9-274382 | * | 10/1997 |

* cited by examiner

*Primary Examiner*—Quana M. Grainger
(74) *Attorney, Agent, or Firm*—Fitzpatrick, Cella, Harper & Scinto

(57) ABSTRACT

The present invention relates to a developing apparatus in which a developer bearing body is provided at its longitudinal part with a roughness formed surface, and a leakage preventing member contacts with the developer bearing body outside of the roughness formed surface in a longitudinal direction.

9 Claims, 9 Drawing Sheets

DEVELOPING APPARATUS WITH LONGITUDINAL END LEAKAGE PREVENTING MEMBER IN CONTACT WITH SMOOTH SURFACE PART OF A DEVELOPER CARRYING MEMBER

BACKGROUND OF THE INVENTION

1. Field of the Invention

The present invention relates to a developing apparatus which can be used with an image forming apparatus such as an electrophotographic copying machine, an electrophotographic printer and the like.

2. Related Background Art

In image forming apparatuses of electrophotographic type, an electrostatic latent image formed on an image bearing body is visualized by a developing apparatus as a developer image.

As an example of such developing apparatuses, various dry type one-component developing apparatuses have been proposed and put to a practical use.

Nowadays, since improvement in resolution and clearness of an image have been requested, investigation regarding method and apparatus for forming a thin layer of developer (one-component developer) on a developer bearing body is inevitable and some attempts for improvement have been proposed.

For example, as disclosed in Japanese Patent Application Laid-Open No. 54-43038, an elastic blade (regulating member) made of metal or rubber abuts against a developing sleeve (developer bearing body) so that, by passing developer through an abutment area between the elastic blade and the developing sleeve to regulate the developer, a thin developer layer is formed on the developing sleeve and adequate triboelectricity is applied to the developer in the abutment area.

In this case, when non-magnetic developer is regulated by the elastic blade, a developer supplying member for supplying the developer onto the developing sleeve must be provided additionally. The reason is that, although magnetic developer can be supplied onto the developing sleeve by a force of a magnet disposed within the developing sleeve, the non-magnetic developer cannot be supplied by such a magnetic force.

To this end, a developing apparatus 50 as shown in FIGS. 7 and 8 has been proposed. In this conventional developing apparatus 50, an elastic roller 55 utilizing a foam body made of polyurethane foam or sponge or a fur brush is disposed within a developing container 54 containing non-magnetic developer 53 as a one-component developer. The roller 55 abuts against a developing roller 52 upstream of an elastic blade 51 in a rotational direction of the developing roller. By rotating the elastic roller in a direction shown by the arrow D, the developer 53 is supplied onto the developing roller 52.

As the developing roller 52 is rotated, the developer 53 supplied to the developing roller 52 is sent to an abutment area between the elastic blade 51 and the developing roller 52 to form a thin layer which is in turn used for development of an electrostatic latent image on a photosensitive body 1.

Residual developer 53 (which was not used in the development) remaining on the developing roller 52 is scraped by the elastic roller 55, and new developer is supplied to the developing roller 52 by the elastic roller 55 as mentioned above. Such operations are repeated.

In this case, when a developing roller 52 is formed from metallic material, an elastic blade 51 formed from a thin metal plate is not preferable because of wear of the developing roller. In order to provide a desired thin developer layer, rubber material such as urethane or silicone must be used.

Further, since the surface of the developing roller 52 was subjected to blasting or carbon coating treatment, good carrying of developer 53 can be achieved by moderate unevenness.

Regarding a longitudinal direction of the developing container 54, i.e., an axial direction of the developing roller 52, a roughness formed region 52*a* on the surface of the developing roller 52 has an area greater than an opening portion 57*a* of the developing container, and developing roller end seals 58 are disposed at ends of the opening portion 57*a* so that lateral,leakage of the developer along the longitudinal direction of the developing roller 52 is prevented while sliding the seals frictionally on the surface of the developing roller 52.

With the arrangement as mentioned above, the thin layer of non-magnetic developer can be effectively formed on the developing roller 52.

However, in comparison with a magnetic developing apparatus in which magnetic developer can easily be held on a surface of a developing roller by the action of a magnetic field, since the non-magnetic developer is used, a magnetic adsorbing force cannot be utilized. Thus, it is difficult to prevent leakage of the developer 53 out of the developing apparatus 50 shown in FIG. 8. That is to say, since the developing roller 52 cannot hold any developer other than the frictionally charged developer and an abutment area (hatched area in FIG. 8) is left between the elastic blade 51 and the developing roller 52. The developer can then easily leak outside through a lower part and ends of the developing roller 52, thereby causing developer contamination within the image forming apparatus.

To avoid this, at a developer collecting area of a lower part of the developing container 54, there is provided a flexible seal member 56 lightly abutting against the developing roller 52 and having one end secured to a frame 57 of the developing container 54, thereby permitting passage of non-used developer and preventing the developer 53 within the developing container 54 from leaking through the lower part of the container 54.

While such a developing apparatus is used with a compact copying machine or page printer, recently, in order to facilitate maintenance, a developing cartridge in which a developing apparatus is formed as a unit or a process cartridge in which a developing apparatus, a photosensitive drum, a cleaner and a charging device (not shown) are integrally incorporated has been put to practical use as an exchangeable device.

As mentioned above, the developing roller 52 has moderate unevenness obtained by surface blasting or carbon coating treatment. The developer 53 can be effectively carried by such unevenness on the surface of the developing roller 52.

However, if the developing operations using the above-mentioned conventional developing apparatus are repeated multiple times, the roughness formed region 52*a* on the surface of the developing roller 52 shown in FIG. 9 slides frictionally against the end peripheral seal members (leakage preventing members) 58 for preventing the developer from leaking outside. In this case, in an area corresponding to the opening portion 57*a* of the developing container, at both ends of a coated zone of the developing roller 52 coated by the developer, the developer is carried to the frictional sliding surfaces of the end peripheral seal members 58, with the result that the developer is melted on and adhered to the end peripheral seal members 58, thereby worsening sealing ability between the developing roller 52 and the end peripheral seal members 58. As a result, developer leakage occurs to cause serious contamination within the image forming apparatus.

SUMMARY OF THE INVENTION

An object of the present invention is to provide a developing apparatus which can prevent fusion and adhesion of developer on end leakage preventing members.

Another object of the present invention is to provide a developing apparatus in which developer born on a developer bearing body is prevented from entering into sliding surfaces of end leakage preventing members.

Yet another object of the present invention is to provide a developing apparatus which can prevent leakage of developer from end leakage preventing members.

DESCRIPTION OF THE PREFERRED EMBODIMENTS

Now, a developing apparatus according to the present invention will be fully explained with reference to the accompanying drawings.

[First Embodiment]

[Explanation of Entire Image Forming Apparatus]

Figure 1:
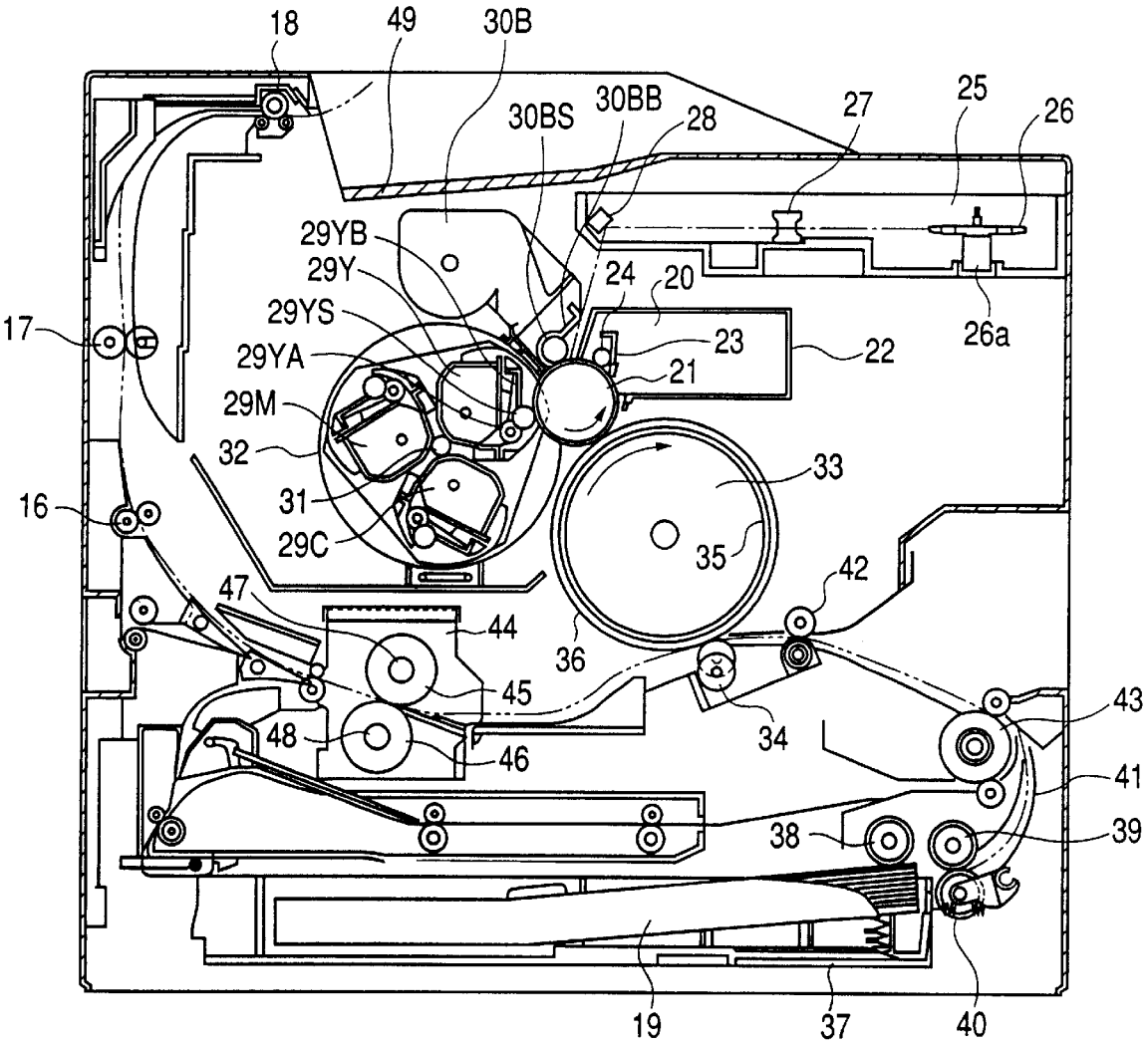
FIG. 1 is a view showing an entire construction of an image forming apparatus using a developing apparatus according to a first embodiment of the present invention.

First of all, an entire construction of a color image forming apparatus will be briefly described with reference to FIG. 1. FIG. 1 shows a color laser printer as an example of the color image forming apparatus.

As shown in FIG. 1, the color laser printer comprises an image forming portion including an image bearing body (photosensitive drum) 21 rotated at a constant speed, a fixed black developing device 30B (referred to also as "developing apparatus"), three rotatable color developing devices (yellow developing device 29Y, magenta developing device 29M, cyan developing device 29C; referred to also as "developing apparatus"), and an intermediate transfer body 33 for holding color images developed in the image forming portion and transferred in a superimposed fashion and for transferring the color images onto a transfer material 19 fed from a transfer material feeding portion. The transfer material 19 to which the color images were transferred from the intermediate transfer body 33 is conveyed to a fixing device 44, where the color images are fixed to the transfer material 19. Thereafter, the transfer material is discharged onto a discharge portion 49 provided on an upper surface of the printer by discharge rollers 16, 17, 18.

Incidentally, the three color developing devices and the fixed black developing device are detachably attachable to a main body of the printer independently as developing cartridges.

Next, constructional parts of the image forming apparatus will be fully described in order.

[Image Bearing Body Unit]

An image bearing body unit 20 integrally includes an image bearing body 21, and a container 22 of a cleaning device also acting as a holder for the image bearing body 21. The image bearing body unit 20 is detachably supported with respect to the main body of the printer so that it can easily be exchanged when a service life of the image bearing body 21 is expired.

The image bearing body 21 of the present embodiment is constituted with an organic photoconductive body layer which is applied outside of an aluminum cylinder having a diameter of 62 mm, and is supported rotatably to the container 22 of the cleaning device as mentioned above.

Around the image bearing body 21, there are disposed a cleaner blade 23 and a primary charging means 24, and, the image bearing body 21 is rotated in an counter clockwise direction in FIG. 1 in response to an image forming operation by transmitting a driving force from a drive motor (not shown) to one end of the image bearing body 21.

[Charging Means]

The charging means 24 comprises a conductive roller of contact charging type. By applying voltage to the conductive roller 24 urged against the image bearing body 21, the surface of the image bearing body 21 is uniformly charged.

[Exposure Means]

Exposure on the image bearing body 21 is effected by a scanner portion 25. That is to say, when an image signal is given to a laser diode, the laser diode emits image light corresponding to the image signal to a polygon mirror 26.

The polygon mirror 26 is rotated at a high speed by a scanner motor 26*a*. The image light reflected by the polygon mirror 26 selectively exposes the surface of the image bearing body 21 (rotated at the constant speed) through a focusing lens 27 and a reflection mirror 28, with the result that the electrostatic latent image is formed on the image bearing body 21.

[Developing Means]

In order to visualize the electrostatic latent image, the developing means includes the three rotatable developing devices 29Y, 29M, 29C and the black developing device 30B for permitting yellow (Y) development, magenta (M)

development, cyan (C) development and black (B) development, respectively.

The black developing device 30B is a fixed developing device in which a developing roller (developer bearing body) 30BS is opposed to the image bearing body 21 with a small gap (about 300 μm) therebetween so that the electrostatic latent image on the image bearing body 21 is visualized as a toner image by applying developing bias to the developing roller 30BS.

In the black developing device 30B, toner in a container is fed onto the developing roller 30BS by a toner feed mechanism, and a thin toner layer is formed on the peripheral surface of the developing roller 30BS rotated in a clockwise direction by means of a coating blade 30BB urged against the peripheral surface of the developing roller 30BS. Meanwhile, charges are applied to the toner (frictional charging).

The three rotatable developing devices 29Y, 29M, 29C contain toners each having an amount corresponding to 6000 sheets (A4 size; 5% print) and are detachably supported (as developing cartridges) by a developing rotary 32 rotated around a shaft 31.

In the image formation, the developing devices supported by the developing rotary 32 are rotated around the shaft 31 so as to position a selected developing device in a confronting relationship to the image bearing body 21 and stop it there, with the result that the developing roller is opposed to the image bearing body 21 with a small gap (about 300 μm) therebetween. Thereafter, the electrostatic latent image on the image bearing body 21 is visualized as a visualized image.

During the color image formation, whenever the intermediate transfer body 33 is rotated by one revolution, the developing rotary 32 is rotated so that the developing processes are successively effected by the yellow developing device 29Y, magenta developing device 29M, cyan developing device 29C and black developing device 30B, respectively.

Figure 2:
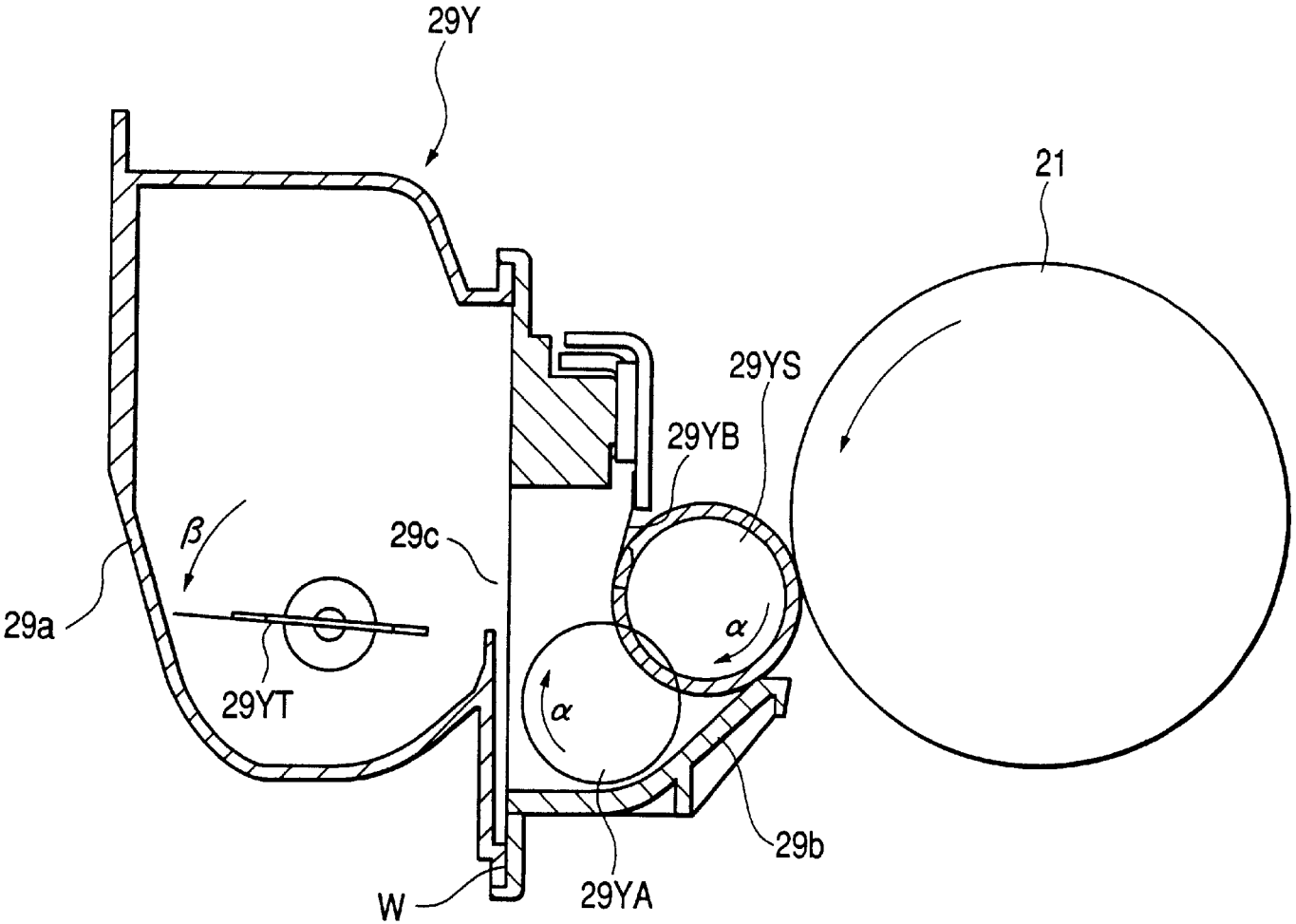
FIG. 2 is a sectional view showing the developing apparatus according to the first embodiment of the present invention.

FIG. 2 shows a condition that the yellow developing device 29Y is positioned in a confronting relationship to the image bearing body unit 20 and is stopped there. In the yellow developing device 29Y, toner in a container 29a is fed onto a coating roller 29YA by a feed mechanism 29YT, and a thin toner layer is formed on the peripheral surface of a developing roller 29YS rotated in a clockwise direction by means of the coating blade 29YA rotated in a clockwise direction and a developing blade (regulating member) 29YB urged against the peripheral surface of the developing roller 29YS. Meanwhile, charges are applied to the toner (frictional charging).

By applying developing bias to the developing roller 29YS opposed to the image bearing body 21 on which the latent image was formed, the latent image is developed by the toner.

Regarding the magenta developing device 29M and the cyan developing device 29C, development is effected in the same mechanism.

Further, when the developing device 29Y, 29M or 29C is rotated to the developing station, the developing roller of the developing device 29Y, 29M or 29C is connected to a corresponding high voltage source and a corresponding drive means of the main body of the printer;so that voltage is selectively applied to the developing roller and a driving force is transmitted.

[Intermediate Transfer Body]

During the color image formation, the intermediate transfer body 33 is rotated in a clockwise direction synchronous with an outer peripheral speed of the image bearing body 21 in order to receive four toner images (yellow, magenta, cyan and black toner images) visualized on the image bearing body 21 by the developing devices in a superimposed fashion. The intermediate transfer body 33 to which the toner images were transferred in the superimposed fashion cooperates with a transfer roller 34 (to which voltage was applied) to pinch (therebetween) and convey a transfer material 19; meanwhile, the color toner images on the intermediate transfer body 33 are transferred onto the transfer material 19 collectively in a superimposed fashion.

In the illustrated embodiment, the intermediate transfer body 33 is constituted by an aluminium cylinder 35 having a diameter of 186 mm, and an elastic layer 36 made of middle-resistance sponge or middle-resistance rubber and coated on the cylinder. The intermediate transfer body 33 is rotatably supported and is rotated when a gear (not shown) integral with the intermediate transfer body receives a driving force.

[Cleaning Means]

The cleaning means serves to remove or clean residual toner remaining on the image bearing body 21 after the toner images visualized on the image bearing body 21 by the developing devices were transferred to the intermediate transfer body 33. The removed toner (waste toner) is collected in the cleaning container 22. An amount of the waste toner collected in the cleaning container 22 is selected so that the cleaning container 22 is not filled with the waste toner before a service life of the image bearing body 21 is expired, and, accordingly, the cleaning container 22 is discarded at the same time when the image bearing body 21 is exchanged due to expiration of its service life.

[Sheet Feeding Portion]

The sheet feeding portion serves to feed the transfer material 19 to the image forming portion and comprises a sheet feeding cassette 37 containing a plurality of transfer materials 19, a sheet feeding roller 38, a feed roller 39, a retard roller 40 for preventing double-feeding, a feed guide 41, a convey roller 43, and registration rollers 42.

In the image formation, the sheet feeding roller 38 is rotated synchronous with the image forming operation to separate and feed out the transfer materials 19 one by one, and the separated transfer material is guided by the feed guide 41 to reach the registration rollers 42 through the convey roller 43.

During the image formation, the registration rollers 42 effect a non-rotation operation for stopping and holding the transfer material 19 and a rotation operation for conveying the transfer material 19 toward the intermediate transfer body 33 in accordance with a predetermined sequence, thereby aligning the images to be transferred with the transfer material 19.

[Transfer Portion]

The transfer portion includes the rockable transfer roller 34. The transfer roller 34 is constituted by a metal shaft and a middle-resistance foam elastic body wound around the metal shaft and can be rotated and be rocked in an up-and-down direction.

While the four color toner images are being formed on the intermediate transfer body 33, i.e., while the intermediate transfer body 33 is being rotated by several revolutions, the transfer roller 34 is retarded to a lower position shown by the solid line (where it is spaced apart from the intermediate transfer body 33) not to distort the images.

After the four color toner images were formed on the intermediate transfer body 33, the transfer roller 34 is shifted to an upper position shown by the phantom line where it is urged against the intermediate transfer body 33 with the interposition of the transfer material 19 with predetermined pressure by means of a cam member (not shown) synchronous with the timing for transferring the color toner images onto the transfer material 19. In this case, at the same time, bias is. applied to the transfer roller 34, with the result that the toner images formed on the intermediate transfer body 33 are transferred onto the transfer material 19.

Since the intermediate transfer body 33 and the transfer roller 34 are driven independently, the transfer material 19 pinched therebetween is subjected to the transferring process and, at the same time, is conveyed to the left in FIG. 1 at a predetermined speed to be sent to the fixing portion 44.

[Fixing Portion]

The fixing portion 44 serves to fix the toner images (formed by the developing devices 29, 30) transferred to the transfer material 19 from the intermediate transfer body 33 and, as shown in FIG. 1, it includes a fixing roller 45 for applying heat to the transfer material 19, and a pressure roller 46 for urging the transfer material 19 against the fixing roller 45. The rollers 45, 46 are hollow rollers having heaters 47, 48 therein and are rotated to convey the transfer material 19.

While the transfer material 19 is being conveyed by the fixing roller 45 and the pressure roller 46, by applying heat and pressure to the transfer material, the toner images are fixed to the transfer material 19.

Next, construction of the developing devices 29Y, 29M, 29C which are characteristic portions of the present invention will be explained with reference to FIGS. 2 to 4 in connection with the yellow developing device 29Y as an example. Incidentally, hereinafter, the yellow developing device 29Y is referred merely as "developing device 29".

The developing device 29 has a developing container obtained by welding (ultrasonic welding in the illustrated embodiment) a container frame 29*a* and a developing frame 29*b* at a welding surface W. Before use, an opening portion 29*c* of the container frame 29*a* communicated with the developing frame 29*b* is sealed by a developer seal (not shown). In use, the developer seal is removed so that the developer in the container frame 29*a* can be fed into the developing frame 29*b*.

In a condition that the developing device 29 is mounted on the main body of the image forming apparatus, when the developing roller 29YS is opposed to the image bearing body 21 by index rotation effected by the developing rotary 32, rotational forces are applied from the drive source of the main body of the image forming apparatus to the developing roller 29YS and the developer feed member 29YT through a shaft coupling and a gear train (both not shown), with the result that the developing roller 29YS is rotated in a direction shown by the arrow α. Further, the developer feed member 29YT is rotated in a direction shown by the arrow β. Consequently, the developer in the container frame 29*a* is shifted to the developing frame 29*b* and the developer is coated on the developing roller 29YS by the coating roller 29YA. A thickness of a developer layer on the developing roller 29YS is regulated by the developing blade 29YB, and the developer is fed out toward the photosensitive drum 21.

Figure 3:
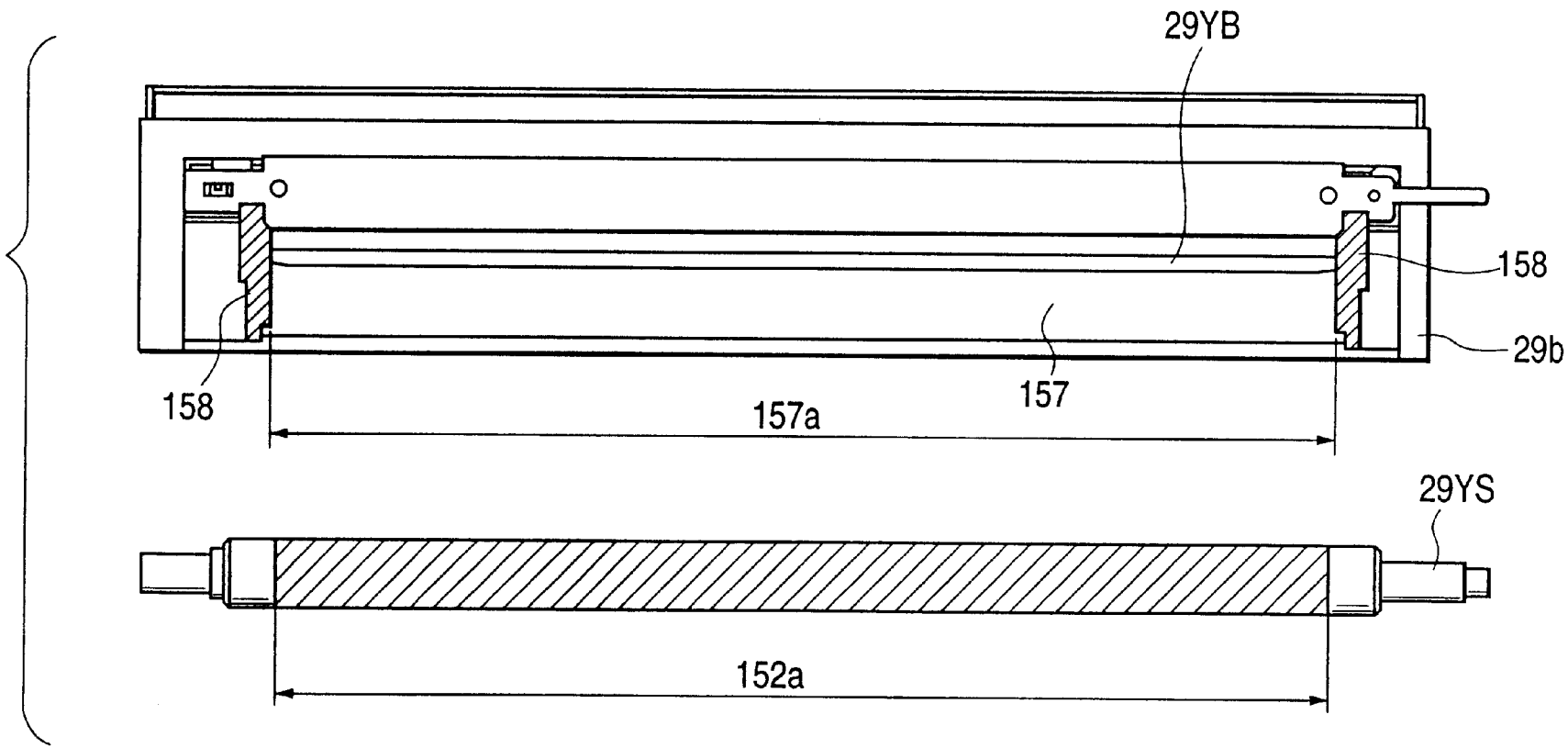
FIG. 3 is an explanatory view showing a positional relationship between a developing roller, a developing blade and end peripheral seal members according to the first embodiment, with the developing roller separated.
Figure 4:
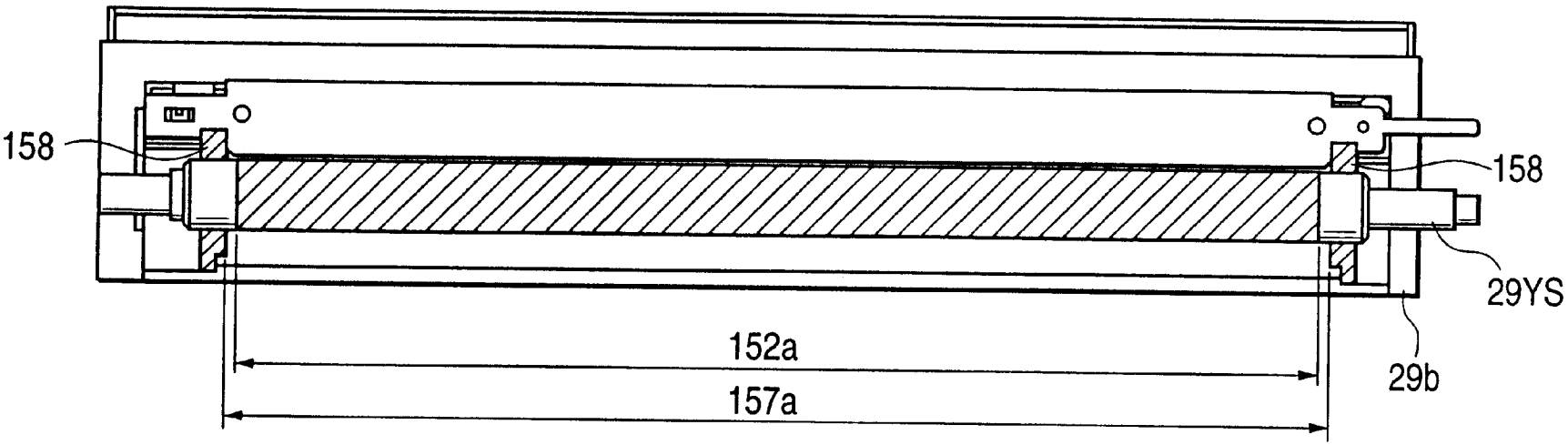
FIG. 4 is an explanatory view showing a positional relationship between the developing roller and the developing blade according to the first embodiment, in a condition that the developing roller is attached.

The developing blade 29YB shown in FIGS. 3 and 4 has a length equal to a longitudinal dimension 157*a* of the opening portion 157 and is disposed at the opening portion 157 of the developing frame 29*b*. End peripheral face seal members 158 for preventing developer from leaking laterally of the developing roller 29YS are provided on both outer ends of the opening portion 157 so that the seals abut against the developing blade 29YB to prevent leakage of developer through the developing blade. Each of the end peripheral face seal members 158 has a felt surface, electrostatic brush (electrostatically translated hair) surface or the like and an elastic substrate or base.

The surface of the developing roller 29YS on which the thickness of the developer layer is regulated by the developing blade 29YB has moderate unevenness for effectively conveying the developer. In the illustrated embodiment, regarding the developing roller, a surface of an aluminium sleeve having a diameter of 20 mm is subjected to carbon coating treatment to obtain surface roughness Ra of about 0.8 μm. Incidentally, the surface roughness Ra is preferably equal to or greater than about 0.3 μm.

A range of the surface of the developing roller 29YS on which moderate unevenness is formed is selected so that a surface roughness formed region 152*a* of the developing roller 29YS suitable for conveyance of developer is equal to or smaller than the longitudinal dimension 157*a* of the opening portion, in order to reduce a developer holding force of areas of the developing roller 29YS frictionally sliding against the end peripheral face seal members 158 in such a manner that, when the developing roller 29YS conveys the developer, the developer is prevented from entering into the frictional sliding area between the end peripheral face seal members 158 and the developing roller 29YS to worsen the sealing ability due to fusion of developer. The seal members 158 do not contact with the roughness formed region of the developing roller and contact with smooth areas outside of the roughness formed region in the longitudinal direction.

With the arrangement as mentioned above, the developer holding force of the areas of the developing roller outside of the opening portion of the developing container is reduced, thereby preventing the developer from being carried from both ends of the developer coated area of the developing roller to the frictional sliding surfaces of the end peripheral face seal members at a zone corresponding to the opening portion of the developing container to prevent fusion and adhesion of developer on the end peripheral face seal members, and, thus, to prevent developer leakage which may cause serious contamination within the image forming apparatus.

[Second Embodiment]

Next, a second embodiment of the present invention will be explained with reference to FIGS. 5 and 6.

In the second embodiment, a longitudinal dimension of the developing blade 29YB is selected to be greater than an opening portion 257 of the developing frame, and end peripheral face seal members 258 for preventing developer from leaking laterally of the developing roller 29YS are provided on both ends of the opening portion 257 of the developing frame. Each of the end peripheral face seal members 258 has a felt surface or electrostatic brush surface and an elastic substrate or base.

Figure 5:
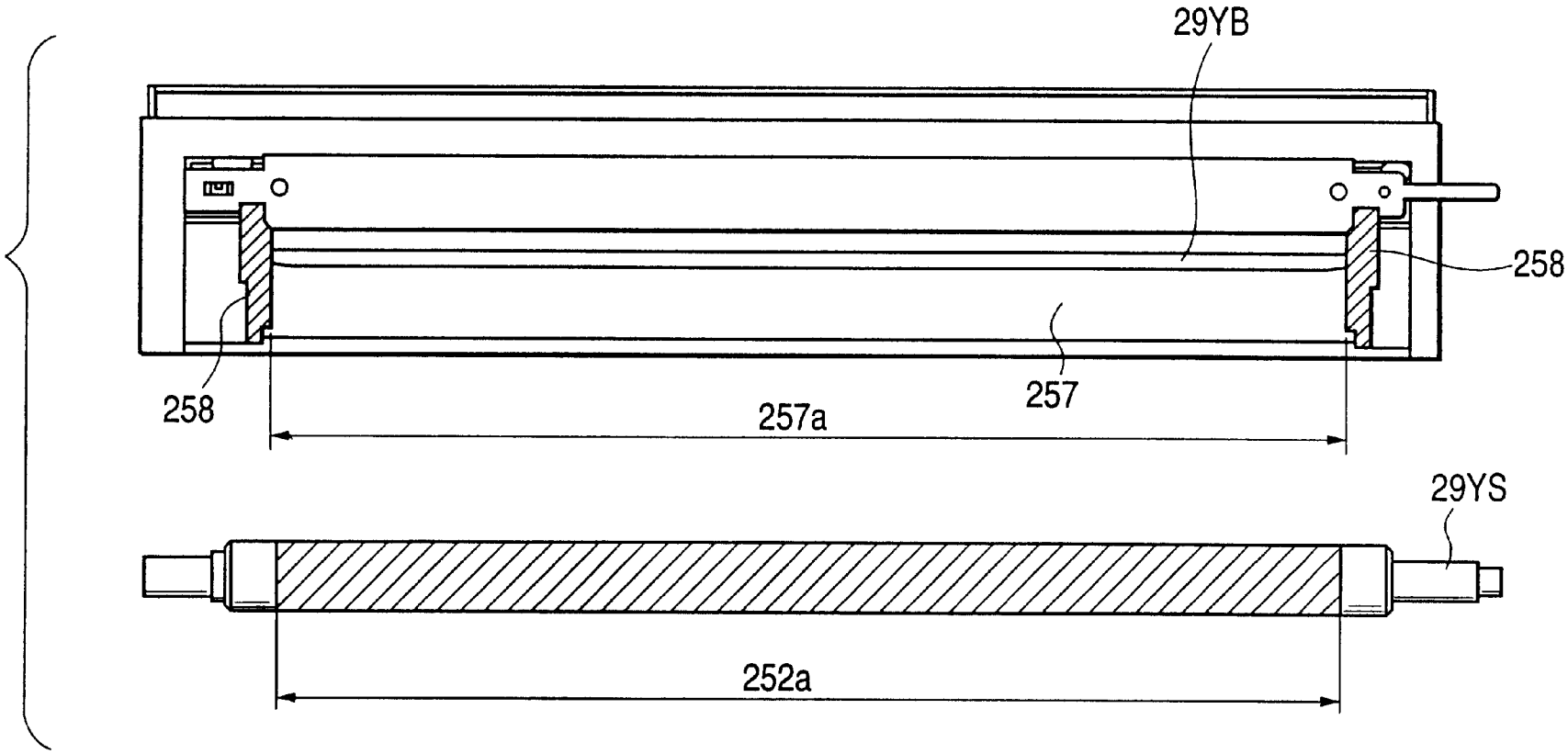
FIG. 5 is an explanatory view showing a positional relationship between a developing roller, a developing blade and end peripheral seal members according to a second embodiment of the present invention, with the developing roller separated.
Figure 6:
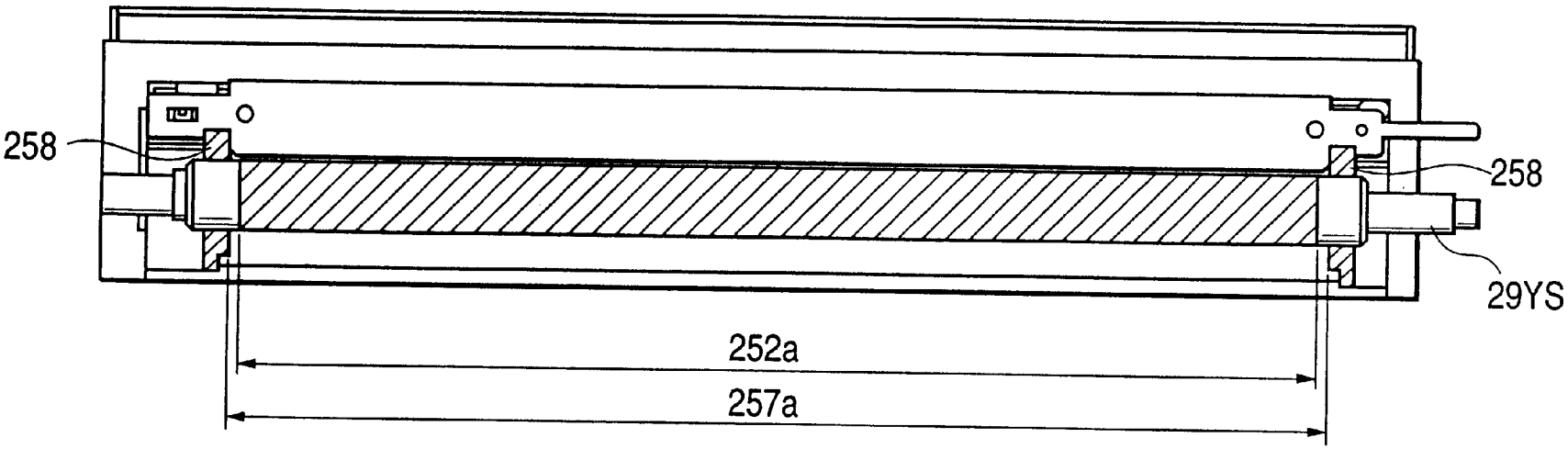
FIG. 6 is an explanatory view showing a positional relationship between the developing roller and the developing blade according to the second embodiment, in a condition that the developing roller is attached.
Figure 7:
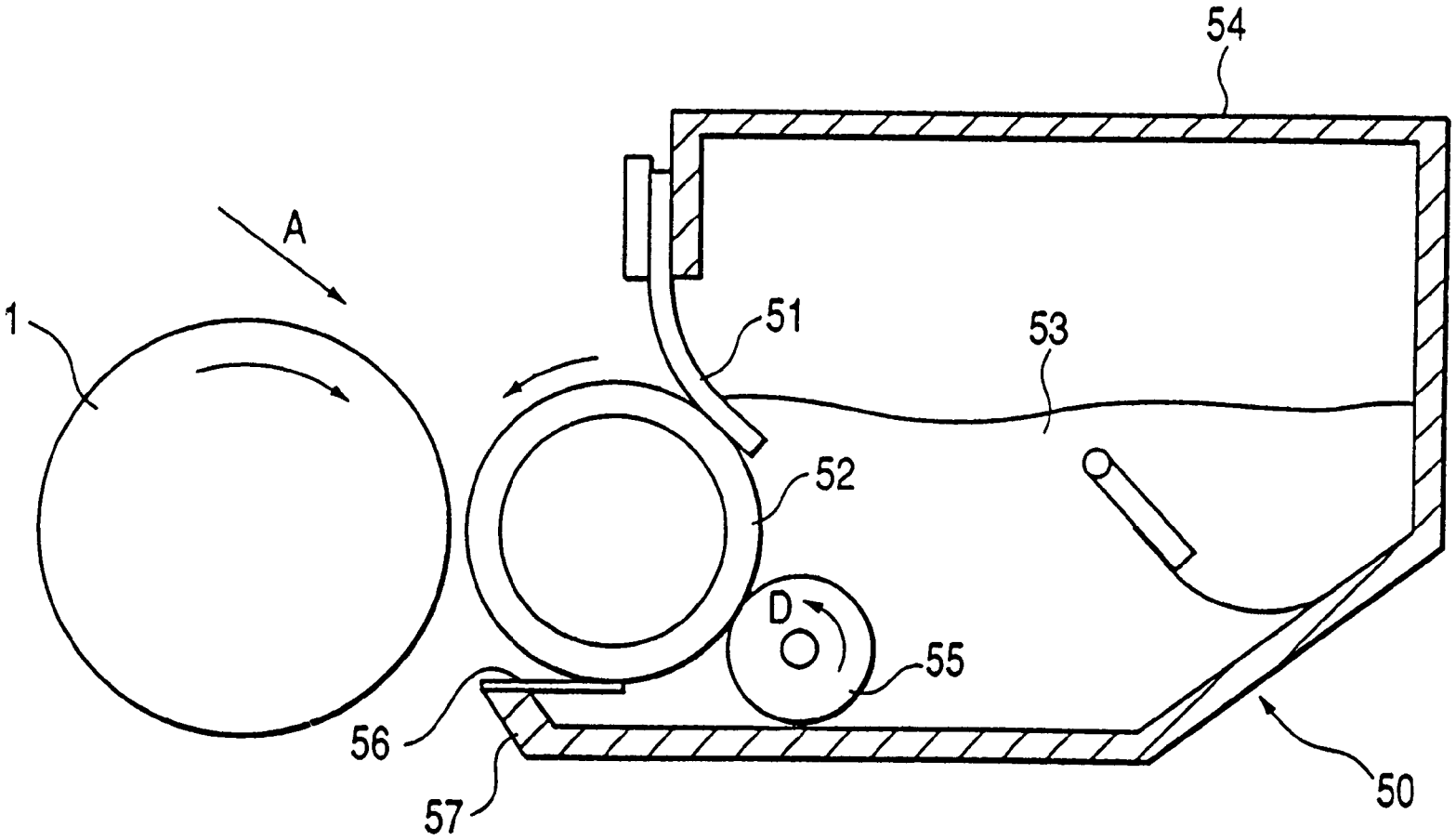
FIG. 7 PRIOR ART
FIG. 7 is a sectional view showing an example of a conventional developing apparatus.
Figure 8:
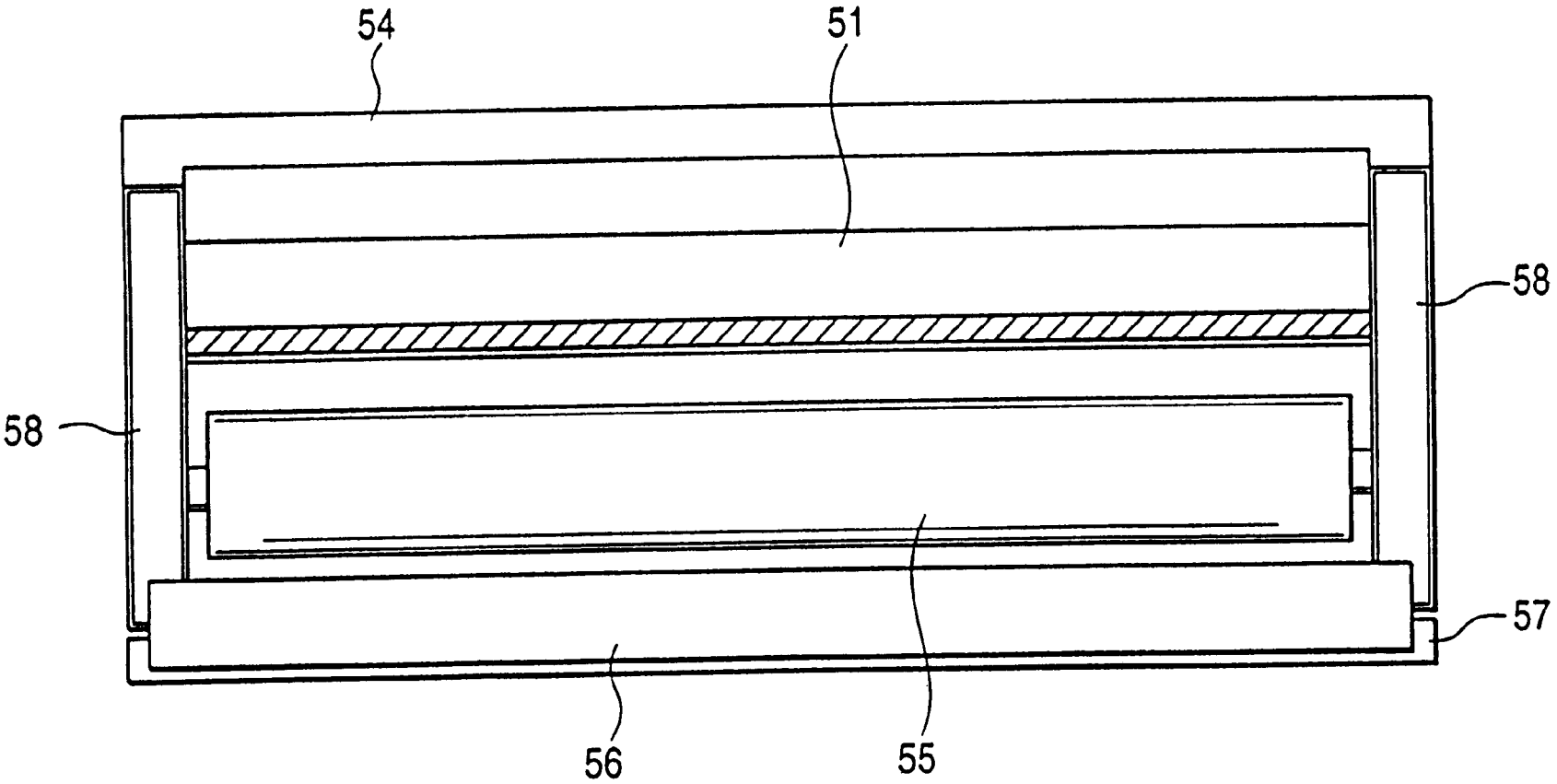
FIG. 8 PRIOR ART
FIG. 8 is a view of the developing apparatus of FIG. 7 looked at from a direction shown by the arrow A, with a developing roller omitted.
Figure 9:
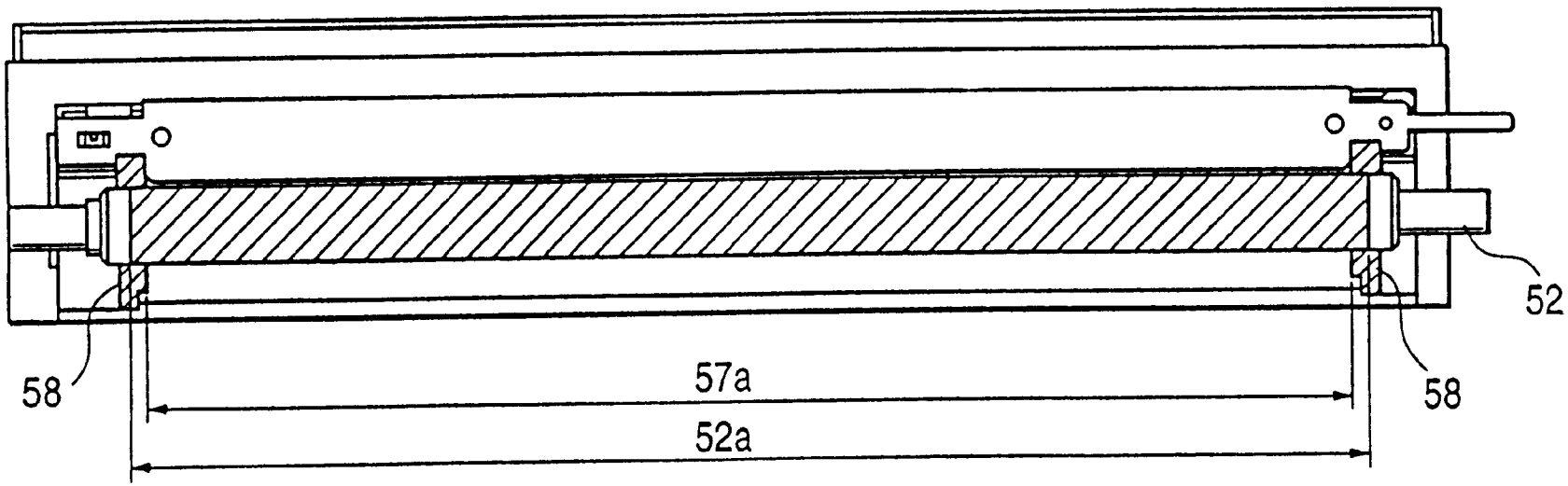
FIG. 9 PRIOR ART
FIG. 9 is an explanatory view showing a positional relationship between the developing roller and a developing blade in the developing apparatus of FIG. 7, in a condition that the developing roller is attached.

In order to increase the longitudinal dimension of the developing blade 29YB, as shown in FIG. 5, the developing blade 29YB partially overlaps with parts of the end peripheral face seal members 258 so that the developer is prevented from leaking through the ends of the developing blade 29YB. That is to say, the ends of the developing blade 29YB are pinched between the developing roller 29YS and the end peripheral face seal members 258.

With the arrangement as mentioned above, a relationship between a surface roughness formed region 252*a* of the developing roller 29YS suitable for conveyance of developer and the longitudinal dimension of the developing blade 29YB is selected so that the moderate surface roughness formed region 252*a* of the developing roller 29YS becomes smaller than the developing blade 29YB.

In this arrangement, the developing blade 29YB partially overlaps with parts of the end peripheral face seal members 258. Thus, when the developing roller 29YS conveys the developer, the developer is prevented from entering into the frictional sliding area between the end peripheral face seal members 258 and the developing roller 29YS not only to cause fusion of developer but also to cause fusion of developer on the developing blade 29YB, with the result that any gap may be created in a close contact area between the developing blade 29YB and the developing roller 29YS to cause leakage of developer.

To avoid such leakage of developer, the surface roughness formed region 252*a* of the developing roller 29YS suitable for conveyance of developer has a longitudinal dimension smaller than the longitudinal dimension of the developing blade 29YB in order to reduce a developer holding force of areas of the developing roller 29YS frictionally sliding against the end peripheral face seal members 258. The seal members 258 contact with smooth areas of the developing roller 29YS outside of the roughness formed region thereof in the longitudinal direction.

As mentioned above, according to this embodiment, since a relationship between the longitudinal dimension of the surface roughness formed region of the developing roller suitable for conveyance of developer and the longitudinal dimension of the developing blade is selected so that the moderate surface roughness formed region of the developing roller becomes smaller than the developing blade, the developer can be prevented from leaking the close contact area between the developing blade and the developing roller.

What is claimed is:

1. A developing apparatus comprising:

a developer container containing a developer;

a developer carrying body provided in an opening portion of said developer container and adapted to carry the developer to a developing position, said developer carrying body including a rough surface area and a smooth surface area provided outside of said rough surface area in a longitudinal direction of said developer carrying body;

a regulating member for regulating a thickness of a layer of the developer carried on said developer carrying body; and two leakage preventing members contacted with both longitudinal ends of said developer carrying body to prevent leakage of the developer;

wherein a length of said regulating member in the longitudinal direction is longer than a space between said two leakage preventing members, wherein longitudinal ends of said regulating member are nipped at a portion between said developer carrying body and said leakage preventing member, and wherein said nipped portion of said regulating member contacts within said smooth surface area of said developer carrying body.

2. A developing apparatus according to claim 1, wherein said rough surface area has a surface roughness (Ra) equal to or more than 0.3 $\mu$m.

3. A developing apparatus according to claim 1, wherein said rough surface area is subjected to a blasting treatment.

4. A developing apparatus according to claim 1, wherein said rough surface area is subjected to a carbon coating treatment.

5. A developing apparatus according to claim 1, wherein, in the longitudinal direction, a length of said rough surface area is equal to or smaller than a length of said opening portion of said developer container.

6. A developing apparatus according to claim 1, wherein said nipped portion is remote from a boundary portion between said rough surface area and said smooth surface area in the longitudinal direction of said developer carrying body.

7. A developing apparatus according to claim 1, wherein the developer is a non-magnetic, one-component developer.

8. A developing apparatus according to claim 1, wherein said developing apparatus is detachably attachable to a main body of an image forming apparatus.

9. A developing apparatus according to claim 1, wherein said developing apparatus is provided within an image forming apparatus and develops an electrostatic image formed on an image bearing body provided within said image forming apparatus.

* * * * *

UNITED STATES PATENT AND TRADEMARK OFFICE

CERTIFICATE OF CORRECTION

PATENT NO. : 6,549,735 B2
DATED : April 15, 2003
INVENTOR(S) : Akiyoshi Fujita et al.

It is certified that error appears in the above-identified patent and that said Letters Patent is hereby corrected as shown below:

Column 2,
Line 17, "lateral, leakage" should read -- lateral leakage --.

Column 5,
Line 62, "printer; so" should read -- printer so --.

Column 7,
Line 6, "is." should read -- is --; and
Line 33, "referred" should read -- referred to --.

Column 10,
Line 3, "developer;" should read -- developer, --.

Signed and Sealed this

Twenty-eighth Day of October, 2003

JAMES E. ROGAN
*Director of the United States Patent and Trademark Office*